United States Patent [19]

Gottlieb

[11] Patent Number: 4,781,959

[45] Date of Patent: Nov. 1, 1988

[54] PROTECTIVE AND/OR CAMOUFLAGE MATERIAL

[76] Inventor: Willi Gottlieb, No. 110 A St. Kongensgade, DK-1264 Copenhagen K, Denmark

[21] Appl. No.: 46,042

[22] PCT Filed: Aug. 1, 1986

[86] PCT No.: PCT/DK86/00084

§ 371 Date: Mar. 20, 1987

§ 102(e) Date: Mar. 20, 1987

[87] PCT Pub. No.: WO87/00913

PCT Pub. Date: Feb. 12, 1987

[30] Foreign Application Priority Data

Aug. 2, 1985 [DK] Denmark ..... 3532/85

[51] Int. Cl.[4] ..... F41H 3/00

[52] U.S. Cl. ..... 428/95; 428/96; 428/907; 428/919

[58] Field of Search ..... 428/85, 95, 96, 907, 428/919

[56] References Cited

U.S. PATENT DOCUMENTS

| | | | |
|---|---|---|---|
| 4,287,243 | 9/1981 | Nielsen | 428/17 |
| 4,401,712 | 8/1983 | Morrison | 428/907 |
| 4,442,162 | 4/1984 | Kuester | 428/919 |
| 4,500,581 | 2/1985 | Mitomi | 428/85 |
| 4,528,229 | 7/1985 | Gottlieb | 428/85 |

*Primary Examiner*—Marion C. McCamish

*Attorney, Agent, or Firm*—Stevens, Dacis, Miller & Mosher

[57] ABSTRACT

A protective and/or camouflage material is provided, in particular a protective and/or camouflage mat for protecting persons and objects against observation and/or against chemical and biological agents such as nerve gases. With a view to obtain a particularly efficient protection against chemical and biological agents the camouflage material is treated, e.g. coated or impregnated with a substance capable of decomposing and decontaminating chemical and biological agents.

6 Claims, 1 Drawing Sheet

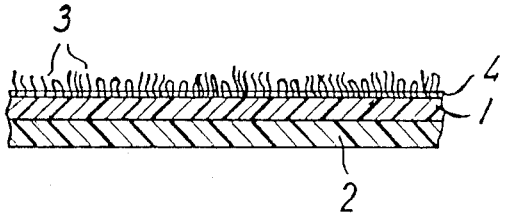
3
4
1
2

PROTECTIVE AND/OR CAMOUFLAGE MATERIAL

This invention relates to a protective and/or camouflage material, in particular protective and/or camouflage mat for protecting persons and objects against observation and/or against chemical warfare agents, such as nerve gases, and biological agents, including toxins.

In war situations it may become necessary to protect persons and objects, such as military equipment and military installations, against observation and against attack by chemical agents, e.g. nerve gases, and biological agents, e.g. microorganisms and toxins.

It is known to protect persons and objects against chemical attacks by means of gas-proof coating materials. Such materials will however be contaminated by gas diffusing into the material and after some time therethrough. Even frequent and thorough decontaminating processes are usually insufficient, and the decontaminating process is further extremely difficult because strongly basic and thus corrosive and etching reagents must be used which per se may be damaging to personnel and equipment and which are unpleasant to work with.

It is known to treat the surface of protective or camouflage material with substances capable of decomposing or decontaminating chemical warfare agents, e.g. by applying such substances contained within gel capsules to the surface of the material. This type of protection is however destroyed when mechanical affected, e.g. in case a vehicle wheel runs over the material.

It is therefore an object of the invention to provide a protective and/or camouflage material which, on one hand, offers a more efficient and durable protection and, on the other hand, is easier to keep clean than prior materials.

For that purpose a protective and/or camouflage material of the type mentioned by way of introduction is according to the invention characterized in that the material is profoundly processed, e.g. impregnated with a substance capable of decomposing and decontaminating chemical and biological warfare agents.

Due to the fact that the material is thus profoundly processed beforehand, i.e. saturated by a substance resisting chemical warfare agents, which immediately when hit by the chemical agent starts reacting therewith, the chemical agent is impeded or even prevented from penetrating the material, thereby considerably increasing the effect of protection. In comparison with said prior art practising surface treatment, it is according to the present invention ensured that the protecting effect of the material is preserved even when exposed to mechanical influences. Moreover, the decontaminating process of the material after an attack by chemical and biological agents is considerably facilitated and it may be effected by substances that are substantially softer to equipment and persons and less injurious to the environment than those hitherto used.

The substance capable of decomposing and decontaminating chemical and biological agents may according to the invention be—or contain—a composition of the enzyme type, e.g. a phosphoryl phosphatase, and/or the class of substances exemplified by ortho-iodosobenzoic acid, the oxidating properties of which give them an anti-bacterial character as well as a chemical agents decomposing character with a specific effect against H-gases (blister gases) and V-gases (nerve gases).

It has virtually been found that certain substances, in particular enzyme containing compositions or compositions based on enzymes, in particular phosphoryl phosphatases or other bond breaking enzyme compositions and/or compositions of the ortho-iodosobenzoic acid type are able to catalyze the hydrolytic decomposition and detoxification of chemical agents in the form of nerve gases, e.g. of the organo phosphor type which in chemical respect is to be regarded as phosphoric esters, and are able to oxide biological agents, including also toxins, and chemical agents, including H-gases and V-gases. If agents of the type mentioned above hit a target protected by the material according to the invention they are to a large extent neutralized before diffusing through the material. The contamination of the material with chemical and biological agents thus assumes the character of an adsorption instead of an absorption, and cleaning, e.g. with the mentioned substances or the like, is much more simple and more gentle than the cleaning of prior protective materials. By the invention the decomposing effect of said substances on chemical and biological agents (catalytic decomposition/oxidation) is utilized both for cleaning and—as preventive measure—to limit or even prevent chemical and biological agents from penetrating.

The FIGURE shows an example of a protective and/or camouflage material to be processed in accordance with the teaching of the present invention appears from the drawing illustrating a protective and/or camouflage mat described in detail in Danish accepted patent specification No. 144,954.

This mat (the FIGURE) comprises a support layer 1 made for instance from rubber or foam plastic and which can be heat insulating.

The side of the support layer 1 which in use faces away from the camouflaged and/or protected object or installation carries a diffusely reflecting material that may be constituted for example of a pile of yarn or synthetic fibres, e.g. polypropylene fibres, of varying lengths, e.g. in the range of 1.5 to 4 cm. Said fibres may be embedded in layer 1 or be fixed to it by weaving or tufting for example into a backing material 4, e.g. constituted of synthetic material, such as polyamide, and which is fixed to layer 1. Loops are formed on the outside of the mat by tufting and some of these loops or all of them may for instance be cut.

Said mat which is described here only to the extent necessary to understand the present invention offers an efficient protection against detection in the optical area, and said protection may be supplemented with a certain protection from radar if in layer 1 reflection attenuating material is embedded, such as radar absorbing fibres or carbon particles and, likewise, metal particles or metallic network may for instance be locally embedded therein which increase the reflection of radar waves, thereby producing a decoy effect to observers and sensors or detectors.

To make such a detection more difficult, thread-like or filamentous metallic or metallized objects, in particular metal threads or metal coated synthetic fibres—possibly together with absorbing objects such as carbon fibres—may be applied to and fastened to support layer 1 with quite arbitrary and different mutual directions and positions, and with quite random spatial orientation and distribution.

It is moreover possible prior to the weaving or the tufting of the pile to weave radar waves affecting filamentous material into the basic materials, e.g. yarns or synthetic fibres, from which the pile is made. Due to the fact that the ends or loops of the yarn or fibre constituting the finished pile extend in any direction and form any angle between 0° and 90° to the surface of the support layer, also the radar affecting thread pieces, i.e. the radar reflecting and radar radiation attenuating thread pieces, will adopt any angle in relation to each other and in relation to the support layer and the radar wave reflection in such a layer will be correspondingly spread and multidirectional, for example from metal thread to metal thread or from metal thread to carbon thread, and the loss of radar energy due to the attenuation and absorption under these internal reflections in the layer will be optimal and, concurrently, the reflection towards a radar detector will be minimal and hardly detectable—at least not unambiguously detectable.

An effective camouflage in the optical and the near infrared range is thus supplemented with an effective camouflage in the radar range, thereby creating the possibility of total camouflage in a simply structured robust and invulnerable camouflage means which can also stand rough handling, e.g. in connection with rapid laying, and which in addition stands traffic.

With a view also to obtain protection against chemical/biological agents, including blister gases and nerv gases, on a volatile or thickened form, and microorganisms and toxins, the mat is treated with substances capable of counteracting such agents, in the present case an enzyme containing composition, e.g. a phosphoryl phosphatase, and/or compositions of the orthoiodosobenzoic acid type. Such compositions have in fact proved to be able to decompose chemical agents, in particular organophosphorus compounds, such as phosphoric esters as they catalyze the hydrolytic decomposition and oxidize chemical and biological agents, resp., thereby considerably accelerating the detoxication of such agents. If, for instance, the pile 3 of mat or the support layer 1 are impregnated with a composition as mentioned above or if such a composition is in any other way applied to the protective material, e.g. is embedded therein, so that the impregnating composition soaks through the material, thereby causing the active substances to deposit in the material, for instance—if layer 1 is a cellular material—in cells of said layer or in pores in the pile fibre material, chemical or biological agents hitting the mat will substantially be neutralized immediately, and the mat is thus more or less self-purifying. If, nevertheless, a contamination of the mat material with chemical/biological agents takes place, such contamination will have the character of an adsorption on the outer surfaces of the material which is comparatively easy to remove, e.g. by substances as mentioned above, contrary to a contamination by absorption, by which the chemical/biological agents penetrate deeply into the material by diffusion.

The processing of the mat material with said substances also entails, beyond the extremely improved protecting effect, that the decontaminating processes become simpler and the intervals between them may be longer.

It is important that the camouflage material by the treatment according to the invention with one or more of said substances does not change its superficial properties but fully preserve its camouflaging effect. This is not the case if prior surface treatment techniques are practised, such as fixation of an active substance by means of a binder, an adhesive, by flocculation or by enveloping.

To further increase the protective ability of the mat against chemical/biological agents the side of the mat facing away from the pile is provided with a layer 2 made from a material hardly to penetrate or impervious to chemical/biological agents, e.g. butyl rubber, polypropylene or polycarbonate, which have proved to be particularly resistant to penetration or diffusion of chemical/biological agents.

I claim:

1. A protective and camouflage material for protecting persons and objects against observation and against chemical warfare agents and biological agents including toxins comprising a pile layer secured to a support layer wherein at least said pile layer is impregnated with a substance capable of decomposing and decontaminating chemical and biological warfare agents.

2. A material as claimed in claim 1, wherein the substance capable of decomposing and decontaminating chemical and biological agents comprises an enzyme.

3. A material of claim 2, wherein the enzyme is selected from the group consisting of phosphoryl phosphatase and an orthoiodosobenzoic acid containing composition.

4. A material as claimed in any one of claims 1 or 2 in the form of a protective and camouflage mat wherein the pile is fibrous and the support layer is selected from the group consisting of rubber and foam plastic.

5. A material as claimed in claim 4, wherein the mat further comprises a diffusion impeding layer.

6. The material of claim 5, wherein the diffusion impeding layer is a material selected from the group consisting of butyl rubber, polypropylene and polycarbonate.

* * * * *